US008128093B1

(12) United States Patent
Gerrish

(10) Patent No.: US 8,128,093 B1
(45) Date of Patent: Mar. 6, 2012

(54) SPINNER BALLS LAWN GAME

(76) Inventor: Reginald Gerrish, Windham, ME (US)

( * ) Notice: Subject to any disclaimer, the term of this patent is extended or adjusted under 35 U.S.C. 154(b) by 0 days.

(21) Appl. No.: 13/031,641

(22) Filed: Feb. 22, 2011

(51) Int. Cl.
*A63B 63/00* (2006.01)

(52) U.S. Cl. ..... 273/343; 473/575; 473/576

(58) Field of Classification Search ..... 273/343, 273/317, 348, 331, 368; 473/569, 575, 576
See application file for complete search history.

(56) References Cited

U.S. PATENT DOCUMENTS

| | | | | |
|---|---|---|---|---|
| 3,701,531 | A * | 10/1972 | Bowers | 273/343 |
| 3,731,931 | A * | 5/1973 | Monaco | 273/343 |
| 5,165,694 | A * | 11/1992 | Kraushaar | 273/343 |
| D478,939 | S * | 8/2003 | McReynolds | D21/302 |
| 7,004,468 | B2 * | 2/2006 | Johnson et al. | 273/343 |
| 7,328,902 | B1 * | 2/2008 | White et al. | 273/343 |
| D578,166 | S * | 10/2008 | Wiroll | D21/302 |
| 7,677,575 | B2 * | 3/2010 | Eisenbarth | 273/343 |
| 2002/0084588 | A1 * | 7/2002 | Lynch | 273/343 |
| 2005/0134000 | A1 * | 6/2005 | Johnson et al. | 273/343 |
| 2008/0093803 | A1 * | 4/2008 | Vallee et al. | 273/343 |
| 2008/0224408 | A1 * | 9/2008 | Eisenbarth | 273/343 |

* cited by examiner

*Primary Examiner* — Raleigh W. Chiu
(74) *Attorney, Agent, or Firm* — Kyle Fletcher

(57) ABSTRACT

The spinner balls lawn game is a game that includes a plurality of stringed ball assemblies and a frame including a series of rotatable arms located thereon. The stringed ball assemblies each consist of two balls each secured to an end of a string, and a middle ball having a hole bored there through and of which said string is threaded thereon such that the middle ball can traverse back and forth along said string and in between the two balls located at each end. The frame supports the rotatable arm across a central arm such that the rotatable arms rotate along a horizontal axis. The rotatable arms and the central arm are each color-coded and upon landing a stringed ball assembly shall award a point designated by the rules of the game. The stringed ball assemblies can impact or land upon the rotatable arms, which may cause the rotatable arms to rotate about the horizontal axis via bearings affixed between the rotatable arms and the central arm.

13 Claims, 4 Drawing Sheets

SPINNER BALLS LAWN GAME

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of lawn games, more specifically, a ladder golf styled game.

B. Discussion of the Prior Art

As will be discussed immediately below, no prior art discloses a ladder golf styled game in which each player is assigned at least one stringed ball assembly, which is hurled at a frame on which a series of arms are rotatably engaged about a central arm; wherein the rotatable arms can rotate about a horizontally-oriented axis that is supported by said frame; wherein each rotatable arm as well as the central arm are color-coded and award a point value specific to the rules of game play; where upon hanging or impact of the stringed ball assembly upon one of the rotatable arms, the rotatable arms can rotate; wherein the stringed ball assembly includes two balls securedly bored through and of which is threaded with said string such that the middle ball can traverse thereon.

The Lima Patent Application Publication (U.S. Pub. No. 2009/0278317) discloses a golf toss game that includes at least two stands with spaced apart bar target members and a plurality of stringed golf balls. However, the golf toss gate does not depict rotatable arms that can rotate about a frame when engaged by stringed ball assemblies.

The LaMarte et al. Patent Application Publication (U.S. Pub. No. 2009/0278316) discloses an illuminated target for a bola toss game. However, the illuminated target is stationary and does not rotate about a supporting frame.

The Johnson et al. (U.S. Pat. No. 7,004,468) discloses a throwing game that includes a rotatable scoring assembly. However, the playing piece does not include a stringed ball assembly that includes a third ball that can traverse along the length of a string defined by balls secured at each end.

The Lynch (U.S. Pat. No. 6,773,014) discloses a rung-go toss and target game. However, the target game does not use a rotatable arms that can rotate when impacted by stringed ball assemblies.

The Deal Patent Application Publication (U.S. Pub. No. 2007/0257438) discloses a ball tossing game that includes at least one horizontal bar and a pair of tossed balls that are tied together for draping over the horizontal bar assembly. Again, the bars do not rotate, and the pair of tossed balls do not include a third ball that can traverse the length of string between both balls.

The Hunt et al. Patent Application Publication (U.S. Pub. No. 2007/0246886) discloses a tethered ball toss and target game and method for playing the game. Again, the cross bars do not rotate, and the pair of tossed balls do not include a third ball that can traverse the length of string between both balls.

The Fuchs Patent Application Publication (U.S. Pub. No, 2007/0035093) discloses a tetheredball toss game. Again, the bars do not rotate, and the pair of tossed balls do not include a third ball that can traverse the length of string between both balls.

The White et al. (U.S. Pat. No. 7,328,902) discloses a target apparatus for a bola toss game. Again, the bars do not rotate, and the pair of tossed balls do not include a third ball that can traverse the length of string between both balls.

The Reid (U.S. Pat. No. 6,308,956) discloses a ball toss game that uses an upright target with three horizontal bars and a number of projectiles that are composed of two balls attached at opposite distal ends of a length of rope. However, the projectiles do not include a third ball that can slide back and forth along the string.

While the above-described devices fulfill their respective and particular objects and requirements, they do not describe a ladder golf styled game in which each player is assigned at least one stringed ball assembly, which is hurled at a frame on which a series of arms are rotatably engaged about a central arm; wherein the rotatable arms can rotate about a horizontally oriented axis that is supported by said frame; wherein each rotatable arm as well as the central arm are color-coded and award a point value specific to the rules of game play; where upon hanging or impact of the stringed ball assembly upon one of the rotatable arms, the rotatable arms can rotate; wherein the stringed ball assembly includes two balls securedly affixed to each end of a string and a middle ball having a hole bored through and of which is threaded with said string such that the middle ball can traverse thereon. In this regard, the spinner balls lawn game departs from the conventional concepts and designs of the prior art.

SUMMARY OF THE INVENTION

The spinner balls lawn game is a game that includes a plurality of stringed ball assemblies and a frame including a series of rotatable arms located thereon. The stringed ball assemblies each consist of two balls each secured to an end of a string, and a middle ball having a hole bored there through and of which said string is threaded thereon such that the middle ball can traverse back and forth along said string and in between the two balls located at each end. The frame supports the rotatable arm across a central arm such that the rotatable arms rotate along a horizontal axis. The rotatable arms and the central arm are each color-coded and upon landing a stringed ball assembly shall award a point designated by the rules of the game. The stringed ball assemblies can impact or land upon the rotatable arms, which may cause the rotatable arms to rotate about the horizontal axis via bearings affixed between the rotatable arms and the central arm.

An object of the invention is to provide a bolla styled game that includes a series of rotatable arms that are engaged upon by stringed ball assemblies.

A further object of the invention is to provide rotatable arms that rotate via bearings along a horizontal axis.

A further object of the invention is to provide color-coded rotatable arms and a central arm, which provide scoring values specific to the rules of the game.

A further object of the invention is to provide stringed ball assemblies that include a ball secured at each end of a string, and a middle ball that can slide back and forth along the string.

These together with additional objects, features and advantages of the spinner balls lawn game will be readily apparent to those of ordinary skill in the art upon reading the following detailed description of presently preferred, but nonetheless illustrative, embodiments of the spinner balls lawn game when taken in conjunction with the accompanying drawings.

In this respect, before explaining the current embodiments of the spinner balls lawn game in detail, it is to be understood that the spinner balls lawn game is not limited in its applications to the details of construction and arrangements, of the components set forth in the following description or illustration. Those skilled in the art will appreciate that the concept of this disclosure may be readily utilized as a basis for the design of other structures, methods, and systems for carrying out the several purposes of the spinner balls lawn game.

It is therefore important that the claims be regarded as including such equivalent construction insofar as they do not depart from the spirit and scope of the spinner balls lawn game. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
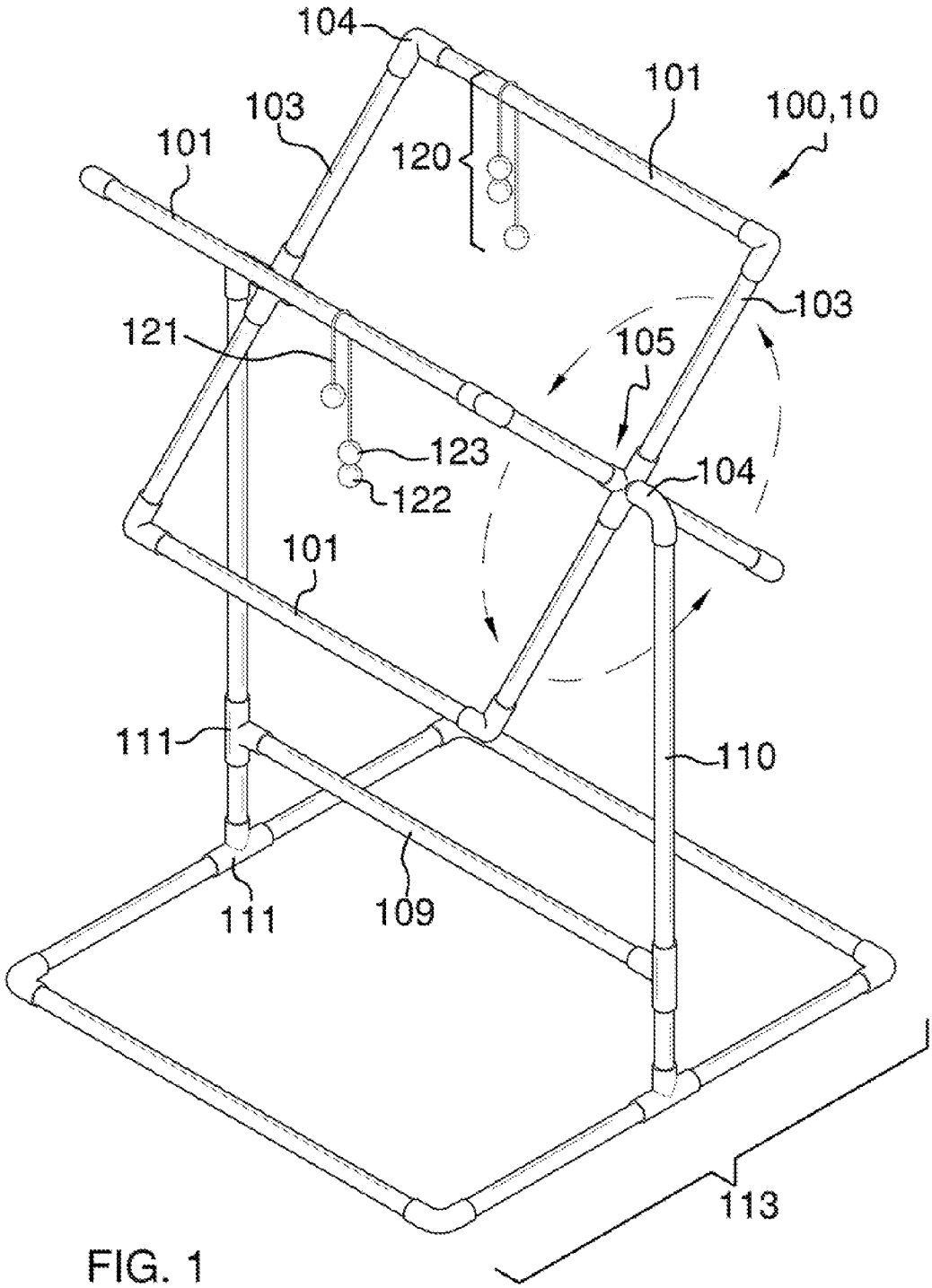
FIG. 1 illustrates a front, isometric view of the spinner balls lawn game by itself and with rotational arrows depicting movement of the rotatable arms.
Figure 2:
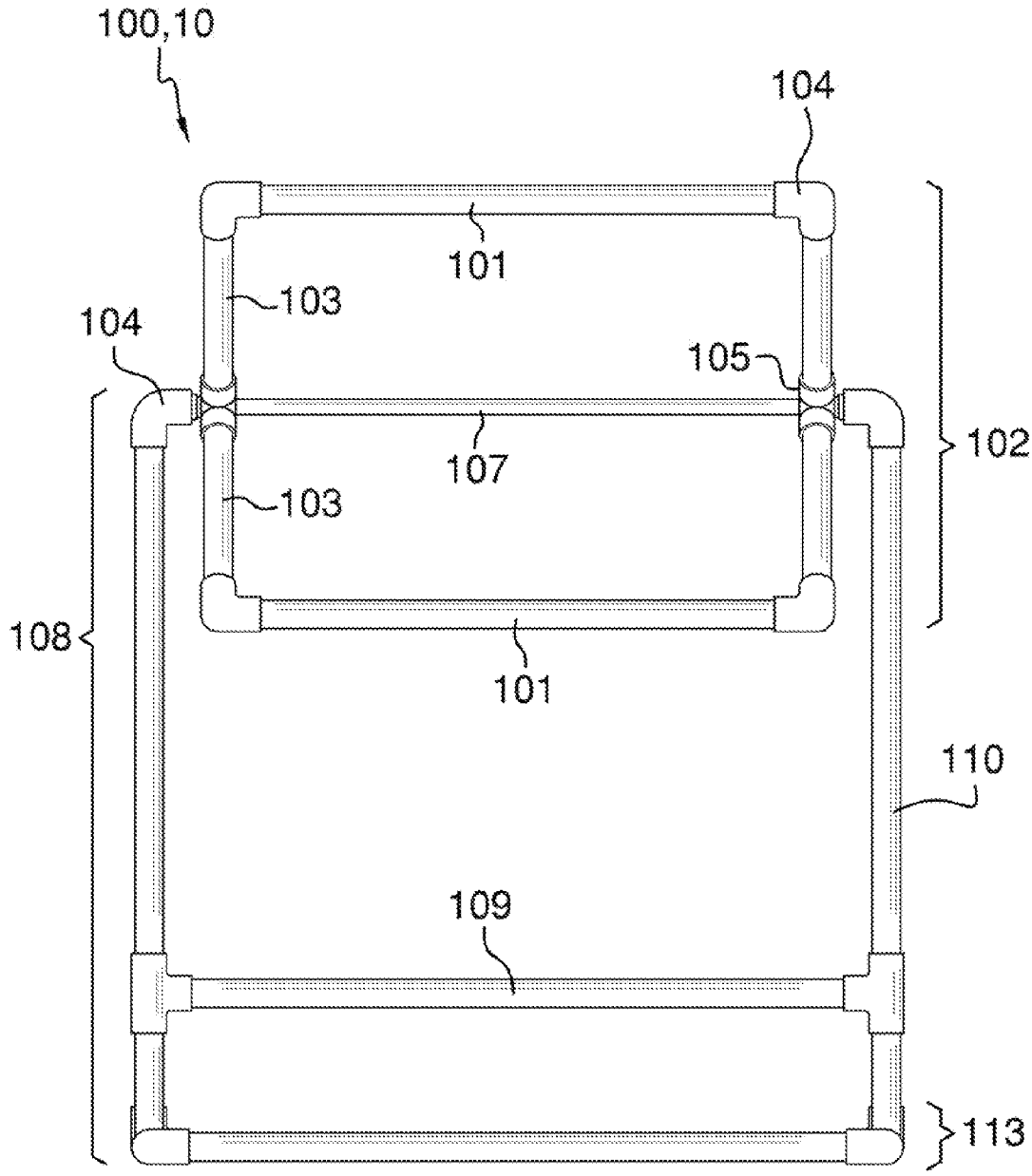
FIG. 2 illustrates a front view of the spinner balls lawn game and depicting the fixed angles formed relative the rotatable arms, the central arm, and the frame.
Figure 3:
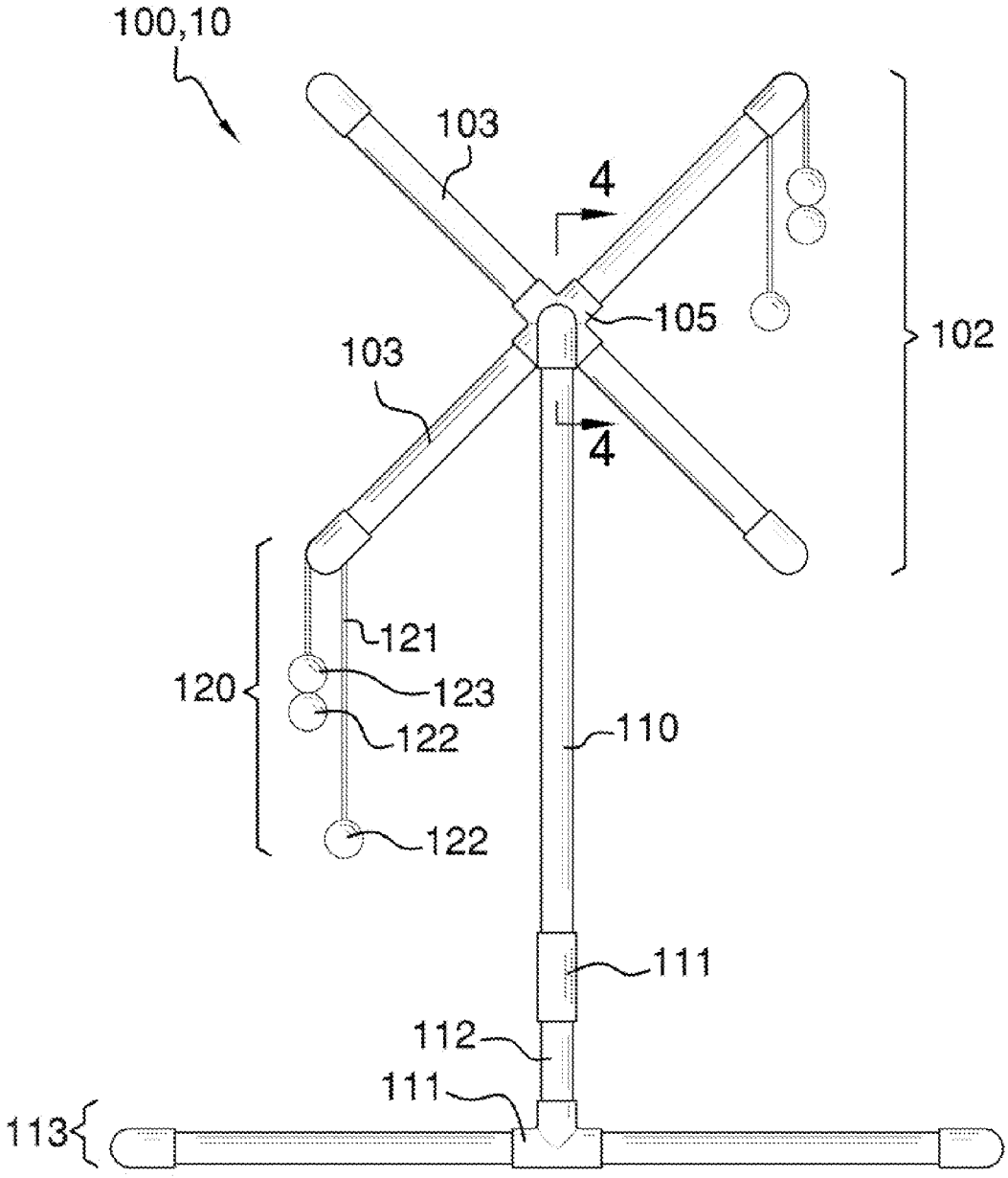
FIG. 3 illustrates a side view of the spinner balls lawn game in which stringed ball assemblies are draped across different rotatable arms, and further defining the angles formed relative the different rotatable arms.
Figure 5:
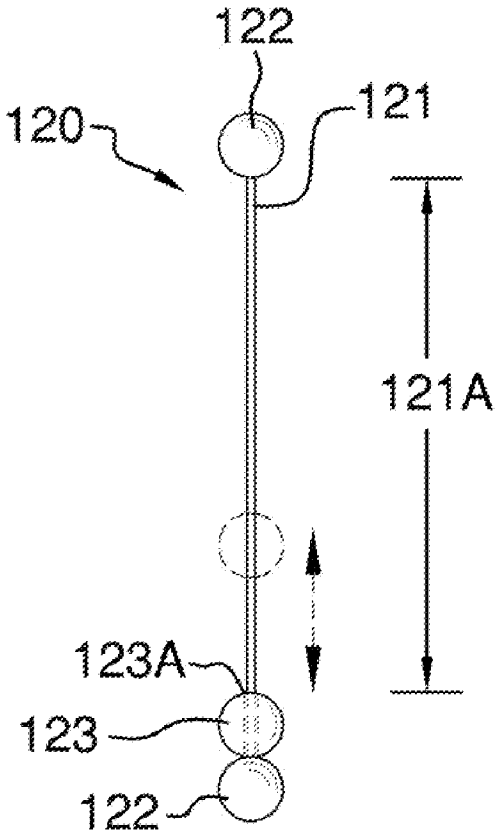
FIG. 5 illustrates a detail of a single stringed ball assembly in which two balls are permanently affixed at each end of the string and further detailing both the hole bored through a middle ball, which can traverse the length of the string as denoted by the vertical arrow.
Figure 4:
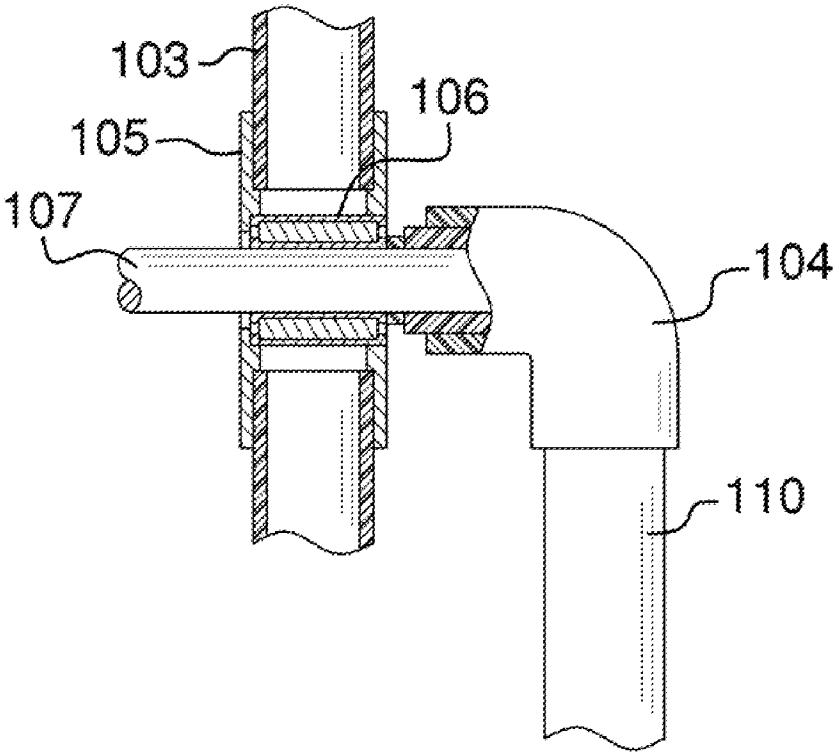
FIG. 4 illustrates a cross-sectional view of the spinner balls lawn game along line 4-4 and detailing one of the bearings used to enable rotational movement of the rotatable arms about the central arm and corresponding frame.

Detailed reference will now be made to the preferred embodiment of the present invention, examples of which are illustrated in FIGS. 1-5. A spinner balls lawn game 100 (hereinafter invention) includes two targets 10 that each include a plurality of rotatable arms 101 that collectively form a rotating scoring assembly 102. The rotatable arms 101 each connect to a riser 103 via an elbow 109. The rotating scoring assembly 102 is composed of four rotatable arms 101 that form an "X" at an intersection 105 on each side of the rotating scoring assembly 102. A bearing 106 is used to support each intersection 105 about a central arm 107.

The rotating scoring assembly 102 can rotate about the central arm 107 via the bearings 106. The axis of rotation of the rotating scoring assembly 102 is horizontal and concentric with the central arm 107. The central arm 107 is attached to a frame 108 via elbows 104. The frame 108 has two functions: (1) to support the rotating scoring assembly 102, and (2) to provide a lower arm 109 onto which the invention 100 may be provided an additional scoring opportunity, which will be discussed further below.

Essentially, the frame 108 includes risers 110 that attach to a T-bracket 111, which connects to both the lower arm 109 and a second riser 112. The second risers 112 each attach to another T-bracket 111, which forms a base 113 of the frame 108.

The frame 108, the rotating scoring assembly 102, and the central arm 107 are all of hollow construction so as to make the components of the invention 100 lightweight, and thus portable. Ideally, the previously mentioned components shall be made of a Polyvinyl Chloride (PVC), but may alternatively be composed of a metal, wood, some other kind of plastic, or a carbon fiber composite.

At least one stringed ball assemblies 120 is provided with the invention 100, and is used in order to play the game, which will be discussed below. The stringed ball assemblies 120 are a unique feature of the invention 100, and are comprised of a string 121 that has a ball 122 secured at each end. A middle ball 123 has a hole 123A bored there through such that the middle ball 123 is threaded with the string 121. Thus, the middle ball 123 can traverse or slide back and forth a length 121A of the string 121 (See FIG. 5).

The stringed ball assemblies 120 may include a color that corresponds to a respective rotatable arm 101, and corresponding player/team. It shall be further noted that the different colors available may come from a group comprising red, blue, green, yellow, orange, black, white, or purple.

To play the game of the invention 100, an end user would align the two targets 10 apart each other by a distance of 40 feet. The gate can be played with up to 4 players or teams of two. Each player/team is designated a color, and a first player/team shall toss one of the stringed ball assemblies 120 at the rotating scoring assembly 102 in order to rotate the rotating scoring assembly 102. Each of the rotatable arms 101 is color coded, and corresponds to the different colors assigned to each player/team. Whichever rotatable arm 101 is closest to the ground shall identify the color of the player/team who picks team/player order. It shall be noted that the initial rotation of the rotating scoring assembly 102 by a single player/team can be done by manually spinning the rotating scoring assembly 102 or throwing a string ball assembly 120 at the rotating scoring assembly 102 thereby causing rotation of the rotating scoring assembly 120. In other words, the color of the rotatable arm 101 awards the respective team/player the right to select which team/player goes $2^{nd}$, $3^{rd}$, and $4^{th}$.

It shall be hereby noted that the rotatable arm 101 that is farthest from a team/player and/or lowest to the ground is more difficult to wrap a string ball assembly 120 upon when compared to the rotatable arm 101 that is closest to a team/player and/or highest to the ground. The being so, the team/ player who gets to select team/player order can take difficulty in looping a stringed ball assembly 120 upon, and can order player/team turn accordingly.

As previously stated, the rotatable arms 101 are each color coded. The rotatable arms 101 and the lower arm 109 are each worth one point. The central arm 107 is worth 2 points. A team/player who loops their stringed ball assembly 120 onto the rotatable arm 101 having the same color shall receive 5 points. The game of the invention 100 is played wherein team/players of one side are assigned to an opposing target 10, and toss their respective string ball assemblies 120 until all are used, and thereafter the respective scores are tallied before the opposing team/players shall repeat with the opposing target 10.

The game is played until the team/player who scores 21 points first and has at least 2 more points than the respective opponents.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly; the invention is to be limited only by the scope of the following claims and their equivalents.

The inventor claims:

1. A spinner balls lawn game comprising:

two targets separated by at least forty feet;

wherein each target is further defined by a rotating scoring assembly that rotates about a central arm, and wherein said central arm is affixed to a frame having a lower arm;

at least one stringed ball assembly is provided and are individually thrown by a player trying to loop said stringed ball assembly onto either the rotating scoring assembly, the central arm, or the lower arm;

wherein the stringed ball assembly is further defined as a string that has a ball secured at each end, and a middle ball that has a hole cored through; wherein the middle ball can traverse a length of the string.

2. The spinner balls lawn game as described in claim 1 wherein the rotating scoring assembly includes a plurality of rotatable arms that extend outwardly from an intersection via risers.

3. The spinner balls lawn game as described in claim 2 wherein the rotating scoring assembly includes four rotatable arms that form an "X" at the intersection.

4. The spinner balls lawn game as described in claim 3 wherein the rotating scoring assembly rotates about the central arm via bearings.

5. The spinner balls lawn game as described in claim 1 wherein the rotating scoring assembly rotates about the central arm along a horizontal axis.

6. The spinner balls lawn game as described in claim 1 wherein the frame includes a base to support the frame vertically as well as to stabilize the central arm.

7. The spinner balls lawn game as described in claim 1 wherein the rotatable arms each include a color that corresponds to a team or player.

8. A spinner balls lawn game comprising:

two targets separated by at least forty feet;

wherein each target is further defined by a rotating scoring assembly that rotates about a central arm, and wherein said central arm is affixed to a frame having a lower arm;

at least one stringed ball assembly is provided and are individually thrown by a player trying to loop said stringed ball assembly onto either the rotating scoring assembly, the central arm, or the lower arm;

wherein the rotating scoring assembly includes a plurality of rotatable arms that extend outwardly from an intersection via risers;

wherein the stringed ball assembly is further defined as a string that has a ball secured at each end, and a middle ball that has a hole cored through; wherein the middle ball can traverse a length of the string.

9. The spinner balls lawn game as described in claim 8 wherein the rotating scoring assembly/includes four rotatable arms that form an "X" at the intersection.

10. The spinner balls lawn game as described in claim 9 wherein the rotating scoring assembly rotates about the central arm via bearings.

11. The spinner balls lawn game as described in claim 8 wherein the rotating scoring assembly rotates about the central arm along a horizontal axis.

12. The spinner balls lawn game as described in claim 8 wherein the frame includes a base to support the frame vertically as well as to stabilize the central arm.

13. The spinner balls lawn game as described in claim 8 wherein the rotatable arms each include a color that corresponds to a team or player.

* * * * *